United States Patent [19]

Rülke

[11] Patent Number: 5,067,062

[45] Date of Patent: Nov. 19, 1991

[54] ILLUMINATION DEVICE FOR A TRANSPORT SYSTEM, ESPECIALLY ESCALATORS OR PASSENGER WALKWAY

[75] Inventor: Gerhart Rülke, Vienna, Austria

[73] Assignee: Inventio AG, Hergiswil NW, Switzerland

[21] Appl. No.: 550,185

[22] Filed: Jul. 9, 1990

[30] Foreign Application Priority Data

Jul. 14, 1989 [CH] Switzerland ..... 02652/89-0

[51] Int. Cl.[5] ..... F21S 3/14

[52] U.S. Cl. ..... 362/146; 362/153; 362/364; 198/337

[58] Field of Search ..... 362/145, 146, 153, 364; 198/321, 335, 337, 338

[56] References Cited

U.S. PATENT DOCUMENTS

| | | | |
|---|---|---|---|
| 2,756,323 | 7/1956 | Tusly | 362/146 |
| 3,057,991 | 10/1962 | Grenadier | 362/146 |
| 3,065,336 | 11/1962 | Stevens | 362/146 X |
| 3,131,871 | 5/1964 | Foulds | 362/146 |
| 4,756,398 | 7/1988 | Watanabe et al. | 198/333 X |

FOREIGN PATENT DOCUMENTS

| | | |
|---|---|---|
| 873122 | 4/1953 | Fed. Rep. of Germany . |
| 1203931 | 10/1965 | Fed. Rep. of Germany . |
| 1274286 | 8/1968 | Fed. Rep. of Germany . |
| 8802483 | 5/1988 | Fed. Rep. of Germany . |

*Primary Examiner*—Allen M. Ostrager

*Attorney, Agent, or Firm*—Sandler, Greenblum & Bernstein

[57] ABSTRACT

With this illumination device for the illumination of a transport system, such as escalators and passenger walkways, light sources are provided in the balustrade skirting. The light of the light source is reflected by lenses upon intermediate legs of a support device which carries the handrail of the transport system. By ascribing a suitable configuration and surface properties to the intermediate legs the light is deflected in a desired direction. This illumination device serves not only for illumination purposes but also for the decorative or aesthetic appearance of escalators and passenger walkways.

19 Claims, 1 Drawing Sheet

ILLUMINATION DEVICE FOR A TRANSPORT SYSTEM, ESPECIALLY ESCALATORS OR PASSENGER WALKWAY

BACKGROUND OF THE INVENTION

The present invention broadly relates to a new and improved construction of an illumination device for transport systems, especially, although not exclusively, for the illumination of escalators or passenger walkways.

There is already known to the art an illumination device according to the German Petty Patent No. 88 02 483.0, published May 19, 1988, in which controllable groups of light sources are arranged along the balustrade at the handrail guide profile and/or at the skirting cover of the escalator or the passenger walkway. The light sources are mounted at the outside and the inside at the balustrade below the handrail in the form of a light rod. If there is used a glass plate for the balustrade then it is possible to ensure for visibility of the light rod at all sides. Furthermore, it has been proposed to arrange the light sources in a sunken arrangement at the inside of the balustrade at the skirting ledge or at the outer balustrade cover ledge.

A drawback of the prior art device resides in the fact that although such type of arrangements achieve an appealing effect, they nonetheless require a high expenditure as concerns their construction and installation. Light sources which are arranged at the handrail guide profile require an increased expenditure in mechanical and electrical equipment. Additionally, such type of illumination devices are only then foolproof against vandalism when they are arranged at the outside or exterior of the escalator. In such an arrangement they only achieve their effect in conjunction with balustrade-glass plates.

SUMMARY OF THE INVENTION

Therefore, with the foregoing in mind, it is a primary object of the present invention to provide a new and improved construction of an illumination device for transport systems, such as escalators and passenger walkways which does not suffer from the aforementioned drawbacks and shortcomings of the prior art constructions.

Another more specific object of the present invention is concerned with an improved illumination system by means of which the illumination and the decorative appearance of escalators or passenger walkways can be appreciably enhanced with the use of most simple means or expedients.

A further significant object of the present invention resides essentially in the fact that the illumination device or system of the present invention affords the advantage that there can be realized savings in technological expenditure and the constructional design of the balustrade is facilitated.

BRIEF DESCRIPTION OF THE DRAWINGS

The invention will be better understood and objects other than those set forth above will become apparent when consideration is given to the following detailed description thereof. Such description makes reference to the annexed drawing wherein the single figure of the drawing depicts in schematic illustration a transport system, such as an escalator or passenger walkway equipped with the illumination device of the present invention.

DETAILED DESCRIPTION OF THE PREFERRED EMBODIMENTS

Figure 1:
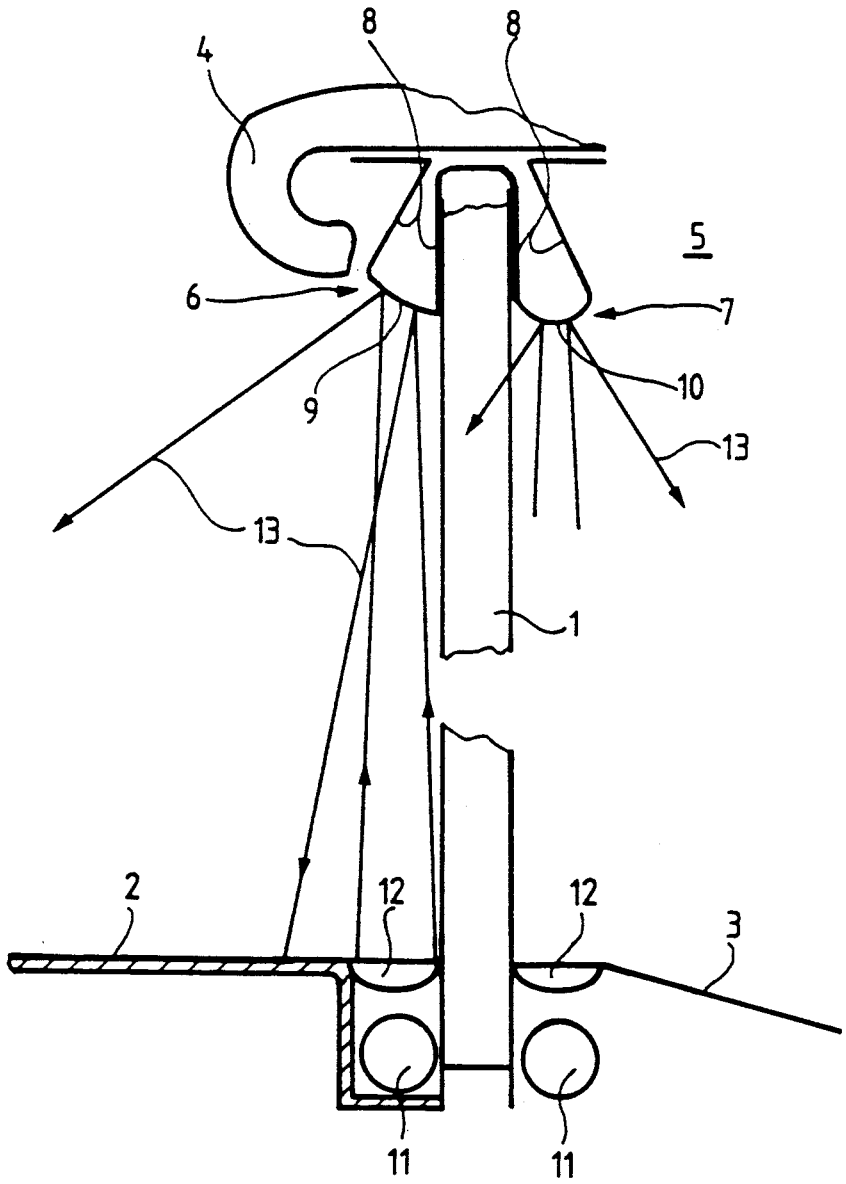

Describing now to the single figure of the drawing, it is to be understood that to simplify the showing thereof, only enough of the construction of the transport system, such as an escalator or passenger walkway equipped with the inventive illumination device or system, has been illustrated therein as is needed to enable one skilled in the art to readily understand the underlying principles and concepts of this invention. Furthermore, since both sides of the transport system are typically similarly designed it will suffice to describe one side thereof.

Turning attention now to the single FIG. 1 it will be understood that reference numeral 1 designates a transparent balustrade which is positionally retained by an outer or external balustrade skirting or socket 2 and an inner balustrade skirting or socket 3. Secured upon the balustrade 1 is a support device or structure 5 which carries a handrail 4. The support device or structure 5 comprises a double U-shaped profile or structural element having a first portion or part 6 and a second portion or part 7. Both of these portions or parts 6 and 7 comprise side or lateral legs or leg members 8.

According to a first embodiment reference numeral 9 represents an intermediate or middle leg of the first part 6. In a further exemplary embodiment reference numeral 10 designates an intermediate or middle leg of the second part 7. In both exemplary embodiments the intermediate or middle legs or leg members 9 and 10 contain convex mirror-like curvatures.

Active light sources 11 mounted in the balustrade skirtings 2 and 3 form in conjunction with lenses, generally indicated by reference numeral 12, and in conjunction with the intermediate legs 9 and 10 effective as passive light sources or light reflecting elements, the inventive illumination device or system. As the active light sources 11 there may be provided fluorescent tubes or neon lamps or glass fiber cables or the like, the emitted light 13 of which is deflected with the aid of the lenses 12 upon the intermediate legs or leg members 9 and 10. According to a further embodiment the elements 12 can be conceptually considered to constitute mirrors for guidance of the light and are used in place of the lenses.

By imparting an appropriate shape or configuration and surface properties to the intermediate or middle legs or leg members 9 and 10 the light is deflected in the proper desired direction. Depending upon the field of application the light sources 11 and the lenses 12 are provided in the outer and/or inner balustrade skirting 2 and 3, respectively. Depending upon the surface properties and the degree of curvature of the intermediate legs 9 and 10 there can be realized decorative lighting effects.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An illumination device for the illumination of a transport system, such as escalators or passenger walkways, comprising:

at least one active light source configured for arrangement at at least a first predeterminate portion of said transport system for emitting light;

lens means cooperating with said at least one active light source for guidance of the emitted light;

means for reflecting light emitted by said at least one active light source configured for arrangement at at least a second predeterminate portion of said transport system; and said transport system comprises a balustrade skirting, a balustrade cooperating with said balustrade skirting and a handrail support device carried by said balustrade, said handrail support device having an underside, wherein:

said at least one active light source for emitting light and said lens means are configured for being arranged in said balustrade skirting; and said means for reflecting light is configured for being arranged at the underside of said handrail support device.

2. The illumination device as defined in claim 1, wherein:

said lens means comprises at least one lens;

said at least one active light source for emitting light, said at least one lens and said means for reflecting light are configured for being arranged at an outer side of said balustrade.

3. The illumination device as defined in claim 1, wherein:

said lens means comprises at least one lens;

said at least one active light source for emitting light, said at least one lens and said means for reflecting light are configured for being arranged at an inner side of said balustrade.

4. The illumination device as defined in claim 1, wherein:

said lens comprises at least two lenses;

said means for reflecting light comprises at least two light reflecting elements;

said at least one active light source for emitting light comprises at least two active light sources;

respective ones of said at least two active light sources, said at least two lenses and said at least two light reflecting elements are configured for being arranged at respective inner and outer sides of said balustrade.

5. The illumination device as defined in claim 1, wherein:

said at least one active light source for emitting light comprises a fluorescent tube means.

6. The illumination device as defined in claim 1, wherein:

said at least one active light source for emitting light comprises glass fiber cable means.

7. The illumination device as defined in claim 1, wherein:

said handrail includes a handrail having intermediate leg means; and said intermediate leg means comprises said means for reflecting light.

8. The illumination device as defined in claim 7, wherein:

said intermediate leg means possess a convex mirror-like curvature.

9. An apparatus comprising:

(a) a transport system including a movable portion and a fixed portion proximate said movable portion; and (b) an illumination device comprising:

(i) means for emitting light, said light emitting means being arranged at at least a first predeterminate portion of said fixed portion of said transport system; and (ii) means for reflecting light, said light reflecting means being arranged at at least a second predeterminate portion of said fixed portion of said transport system in a manner to direct light emitted by said light emitting means toward said movable portion of said transport system.

10. The apparatus of claim 9, further comprising:

means, positioned between said light emitting means and said light reflecting means, for guiding light emitted by said light emitted means toward said light reflecting means.

11. The apparatus of claim 10, wherein:

said means for guiding light comprises at least one lens.

12. The apparatus of claim 9, wherein:

said fixed portion of said transport system comprises a balustrade and a handrail support carried by said balustrade, said handrail support having an underside; and said light emitting means is arranged below said handrail support for emitting light toward said underside of said handrail support, and said light reflecting means is arranged at said underside of said handrail support.

13. The apparatus of claim 12, wherein:

said fixed portion of said transport system further comprises a balustrade skirting arranged at a lower portion of said balustrade, said balustrade skirting having an upper surface, said light emitting means being located below said upper surface of said balustrade skirting.

14. The apparatus of claim 12, wherein:

said balustrade comprising an inner side, proximate said movable portion of said transport system, and an outer side, and an outer side, said light emitting means comprising at least one light emitting element arranged at said inner side of said balustrade.

15. The apparatus of claim 12, wherein:

said balustrade comprising an inner side, proximate said movable portion of said transport system, and an outer side, and an outer side, said light emitting means comprising at least one light emitting element arranged at said outer side of said balustrade.

16. The apparatus of claim 12, wherein:

said balustrade comprising an inner side, proximate said movable portion of said transport system, and an outer side, and an outer side, said light emitting means comprising at least one light emitting element arranged at said inner side of said balustrade, and at least one light emitting element arranged at said outer side of said balustrade.

17. The apparatus of claim 12, wherein:

said handrail support comprises at least one intermediate leg arranged proximate said balustrade, said at least one intermediate leg having a surface comprising said light reflecting means.

18. The apparatus of claim 17, wherein:

said surface of said at least one intermediate leg having a convex shape.

19. The apparatus of claim 12, wherein:

said balustrade is transparent.

* * * * *